United States Patent [19]

Setsuie et al.

[11] Patent Number: 4,695,415

[45] Date of Patent: Sep. 22, 1987

[54] METHOD FOR PRODUCING ACRYLIC FIBER PRECURSORS

[75] Inventors: Takashi Setsuie; Takeji Otani; Kanji Yoshida, all of Ohtake, Japan

[73] Assignee: Mitsubishi Rayon Co., Ltd., Tokyo, Japan

[21] Appl. No.: 694,302

[22] Filed: Jan. 24, 1985

[51] Int. Cl.[4] ..... D01F 9/22

[52] U.S. Cl. ..... 264/29.2; 264/29.6; 264/29.7; 264/83; 264/182; 264/206; 264/210.2; 264/210.3; 264/210.5; 264/210.7; 264/210.8; 264/211.15; 264/211.17; 264/232; 264/233; 264/235.6; 264/346; 423/447.4; 423/447.6; 423/447.8; 423/447.7

[58] Field of Search ..... 264/28, 29.2, 182, 29.7, 264/206, 210.2, 210.3, 210.5, 210.7, 210.8, 211.15, 211.17, 235.6, 346, 29.6, 83, 233, 232; 423/447.4, 447.6, 447.8, 447.7

[56] References Cited

U.S. PATENT DOCUMENTS 3,558,761 1/1971 Tobara et al. ..... 264/182
3,636,187 1/1972 Ohfuka et al. ..... 264/182
3,673,035 6/1972 Whitney ..... 264/29.7
3,814,739 6/1974 Takeda ..... 264/182

FOREIGN PATENT DOCUMENTS 0142719 11/1980 Japan ..... 264/29.2

*Primary Examiner*—Jan H. Silbaugh
*Assistant Examiner*—Hubert C. Lorin
*Attorney, Agent, or Firm*—Oblon, Fisher, Spivak, McClelland & Maier

[57] ABSTRACT

An acrylic fiber precursor for high performance carbon fibers free of defects which comprises an acrylonitrile polymer containing at least 90% by weight of acrylonitrile and has a surface roughness of 2.0 to 3.0 with dense inner structure. from a solution comprising 24 to 27.5% of the acrylonitrile polymer is dry-jet wet spun into a coagulation bath consisting essentially of dimethylformamide or dimethylacetamide and having a bath temperature of 5° to 25° C.Carbon fibers obtained by carbonizing these precursor acrylic fibers have no fusion bonding or agglutination of filaments and exhibit high performance.

9 Claims, 4 Drawing Figures

(x 10000)

(x 10000)

METHOD FOR PRODUCING ACRYLIC FIBER PRECURSORS

BACKGROUND OF THE INVENTION

1. Field of the Invention

This invention relates to an acrylic fiber precursor for making carbon fibers which has specific surface characteristics and has a dense inner structure, a method for making said acrylic fiber precursor, a method for making high performance carbon fibers free from fiber defects such as fusion bonding or agglutination from said acrylic fiber precursor and the carbon fibers made thereby.

2. Discussion of the Background

Carbon fibers made from acrylic fiber precursors have high performance and have been used in various fields such as secondary structural materials in aircraft. However, the higher performance carbon fibers are strongly demanded for use as primary structural materials.

Development for making carbon fibers which satisfy such demand has been made and acrylic fiber precursors with a smooth surface have been developed for this purpose. These precursors have a dense structure free of inner voids and considerably high performance carbon fibers can be obtained therefrom.

However, the precursors having high surface smoothness tend to cause undesirable phenomena such as fusion bonding or agglutination of filaments, which bring about defects in the carbon fibers made therefrom at the flameproofing step. For removal of these defects and obtaining precursors from which high performance carbon fibers can always be made, oiling agents used for treatment of these precursors have been carefully selected so as to prevent said fusion bonding or agglutination phenomena at the calcination step of the precursors. However, in order to prevent said undesired defects by such method, there are naturally limitations and precursors which do not bring about the above undesired phenomena without careful selection of the oiling agents have been strongly desired for obtaining high performance carbon fibers.

SUMMARY OF THE INVENTION

Therefore, the object of this invention is to provide acrylic fiber precursors for carbon fibers which have no defects such as fusion bonding or agglutination of filaments without necessity of carefully choosing oiling agents.

DESCRIPTION OF THE INVENTION

The inventors have found that high performance carbon filbers which hitherto have not been able to be obtained can be obtained by calcining acrylic fiber precursors having an dense inner structure and a roughened surface. Thus, this invention has been attained based thereon.

This invention resides in an acrylic fiber precursor for carbon fibers which comprises an acrylonitrile polymer containing at least 90% by weight of acrylonitrile and which has a surface roughness of 2.0 to 3.0 as defined below and a method for making said acrylic fiber precursors. It further resides in a method for making therefrom carbon fibers which comprises calcining said precursors to carbonize them.

The surface roughness referred to hereinabove is measured by the following method using a scanning electron microscope: In order to keep constant the standard conditions of the scanning electron microscope (JSM-35C manufactured by Nippon Denshi Co., Ltd. is used in this invention), conditions are set as follows in this invention. A magnetic tape is used as a standard specimen and a secondary electron line scanning profile of the magnetic tape is obtained under the conditions of accelerating voltage: 10 KV, magnification: X1500 and scanning rate: 4.5 cm/sec. Recording of the secondary electron line scanning profile may be made by any means such as Polaroid films (Registered Trade Name), negative films or the like which can record scanning profiles. It is also possible to employ such a technique that the data with the secondary electron is subjected to analogue-to-digital conversion and fed into a computer to make calculation with continuous monitoring of the standard conditions. Generally, intensity of secondary electrons in a scanning electron microscope depends greatly upon the intensity of the primary incident electrons. Therefore, it is necessary to keep constant the focussing position, current to be fed to a condenser lens which controls the intensity of the electron beam, etc. and the standardizing conditions are set so that average amplitude of the secondary electron line scanning profile obtained from the magnetic tape is 30 mm.

Next, a specimen whose surface roughness is to be measured is kept under said conditions with changing only the magnification (×6,600) and focussing is effected by using a device for adjusting upward and downward directions of the specimen inclining stage. (This focussing with the specimen inclining stage is for keeping constant the diameter of the primary incident electron beam.).

Recording of the secondary electron line scanning profile of the specimen is effected at a scanning rate of 1.7 mm/sec with any of the various recording media as referred to above.

Figure 1:
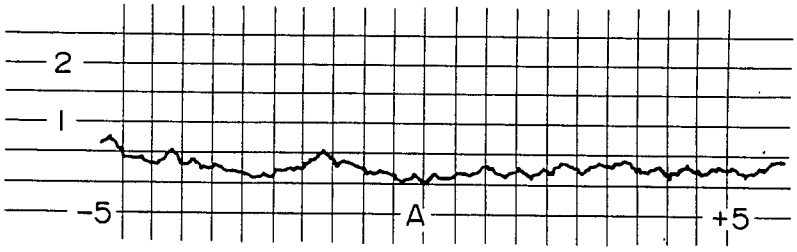
FIG. 1 and FIG. 3 are line scanning secondary electron profiles of the acrylic fiber precursors and FIG. 2 and FIG. 4 are scanning electron photomicrographs of the acrylic fiber precursors.

The profile is further magnified to ×10,000. As shown in FIG. 1, zero level of line scanning (the secondary electron intensity level) is taken as the central position (A) and each of 5 cm therefrom to right and 5 cm therefrom to left (corresponding to 5μ in actual measurement) of the profile is divided into ten equal lengths. The respective height of the profile at a particular division in the direction of the y-axis is read and variance value thereof is calculated according to the following formula (1). An arithmetical mean value of the variances obtained on fifty specimens is taken as the surface roughness.

$$\text{Variance} = \sqrt{\frac{1}{20}\sum_{i=1}^{20}(yi - \bar{y})^2} \quad (1)$$

(wherein yi is the height of the profile at a particular division in the direction of y-axis and $\bar{y}$ is a mean value of the heights in the direction of y-axis).

It is necessary that at least 90% by weight of acrylonitrile is copolymerized in the acrylonitrile polymers used in this invention. High performance carbon fibers cannot be obtained from acrylic fibers of less than 90% by weight in copolymerization amount of acrylonitrile. Furthermore, when such acrylic fibers are used, carbon yield is reduced. Thus, such acrylic fibers are not preferred.

As comonomers which may be copolymerized with acrylonitrile in this invention, mention may be made of acrylic acid, methacrylic acid, itaconic acid, methyl(metha)acrylate, hydroxyalkyl(metha)acrylate, α-chloroacrylonitrile, 2-hydroxyethylacrylonitrile, acrylamide, methacrylamide, dimethylaminoethyl(metha)acrylamide, vinyl acetate, methacrylsulfonic acid, p-styrenesulfonic acid, etc. These comonomers may be used alone or in combination in an amount of 10% by weight or less taking into consideration efficient production of precursors and efficient calcination of precursors.

Acrylic fiber precursors which have hitherto been developed to produce high performance carbon fibers have been considered preferable to have a dense inner structure. When acrylic fibers of such dense inner structure are made by wet spinning method, they have nearly completely round cross section and have a surface roughness of 2.0 or less.

This is due to the fact that production of acrylic fibers having a dense inner structure by conventional wet spinning method can be attained only by mild replacement of solvents in coagulated filaments. Therefore, thus obtained acrylic fibers having a densified inner portion has high surface smoothness. Such acrylic fiber precursors cause phenomena of fusion bonding or agglutination of filaments in the flameproofing calcination process resulting in great difficulty in making carbon fibers having uniform characteristics.

According to this invention, it has become possible by employing the following conditions to provide two opposite characteristics, namely, dense inner structure of coagulated filaments and rough surface which are factors for obtaining high performance carbon fibers.

That is, as conditions for densification of the inner part of acrylic fibers, there are commonly used the means such as increasing the polymer concentration in the spinning solution to the maximum degree at which spinning is still possible, lowering the coagulation bath temperature, reducing the draft at spinning, adding water to the spinning solution, etc. By employing these conditions, coagulated filaments having a dense inner structure can be obtained and this structure can be reflected, nearly as it is, on the structure of final acrylic fiber precursors. However, the surface of fibers obtained by employing only these conditions is generally smooth.

Acrylic fiber precursors which also have roughened surface to satisfy the purpose of this invention can be obtained by the methods such as carrying out the spinning at a conspicuously high extrusion temperature for a spinning solution; subjecting the spun unstretched filaments to shrinking treatment by 1 to 5% in a hot water and then substantial stretching orientation; or using a spinning solution having a polymer concentration increased to the maximum degree at which spinning is still possible and simultaneously therewith increasing the coagulation temperature to allow high coagulating speed.

Especially, the combination of the high polymer concentration in the spinning solution and the high coagulation temperature as referred to above is considered to be effective for the following reason: Although the coagulation speed in the inner part, namely, diffusion speed of coagulant into filaments is slow in the formation of fibrous structure at the time of coagulation, the surface part of the filaments coagulates rapidly due to the high coagulation bath temperature to form a rough coagulated structure, which promotes roughening of the surface of the fibers by the subsequent stretching. Thus, the coagulation manner of the inner portion and that of the surface layer of the filaments can be advantageously separated.

Specifically, the inventors have succeeded in producing acrylic fiber precursors which have a surface roughness of 2.0 to 3.0 obtained from the variance according to formula (1) mentioned hereinabove with a dense inner structure by spinning a spinning solution of an acrylonitrile polymer in dimethylformamide or dimethylacetamide which has a polymer concentration of 24 to 30% by weight, preferably 26 to 27.5% by weight into a coagulation bath comprising water and dimethylformamide or dimethylacetamide at a temperature of −5° C. to 30° C., preferably 5° C. to 25° C. The spinning is carried out by a wet spinning method or a dry-wet spinning method which is carried out by maintaining a distance of 2 to 50 mm, preferably 3 to 20 mm between the nozzle surface and the surface of the coagulation bath. After spinning, in the usual manner the filaments are subjected to simultaneous washing and stretching to 1.05 to 20 times their length in hot or boiling water of 50° C. to 100° C., then application is made of oiling agents such as silicone oil, aminosiloxane, etc. and subsequent dry heat stretching to collapse the inner portion to make densification thereof.

The precursors obtained in accordance with the method of this invention do not cause undesirable phenomena such as fusion bonding or agglutination of filaments with each other at the calcination step and it has become possible to make therefrom carbon fibers which can sufficiently exhibit good characteristics due to the precursors properties.

When the precursors having a surface roughness of less than 2.0 are used, it is difficult to carbonize them with sufficient avoidance of the undesired phenomena such as fusion bonding or agglutination of the filaments at the calcination step even if oiling agents are selected. On the other hand, when the surface roughness of the precursors is more than 3.0, carbon fibers made therefrom also have a high surface roughness and are liable to cause fluffing. Thus, use of such precursors is not preferred.

In production of carbon fibers from thus obtained precursors of this invention having the said characteristics, the precursors are flameproofed and then carbonized. The flameproofing may be effected by a method which comprises heat treating the precursors at 200° C. to 400° C. in an oxidizing atmosphere or a method which comprises oxidizing them with a liquid oxidizing agent and then, if necessary, heat treating them at 200° C. to 400° C. in an oxidizing atmosphere. The carbonization may be carried out by heat treating the thus flameproofed fibers at 500° C. to 1800° C. in a non-oxidizing atmosphere. If necessary, they may be further heat treated at 3000° C. or less to make graphitized fibers.

The carbon fibers thus obtained have proper surface roughness and so are very good in affinity with matrixes such as epoxy resins and metallic materials.

Moreover, carbon fibers having various characteristics such as a strength of at least 300 kg/mm$^2$ and a modulus of elasticity of at least 20 t/mm$^2$, for example, those of a strength of 400 to 600 kg/mm$^2$ and a modulus of elasticity of 20 to 30 t/mm$^2$ or those of a strength of 300 to 450 kg/mm$^2$ and a modulus of elasticity of 35 to 65 t/mm$^2$ can be steadily produced according to this invention. Thus, these carbon fibers have further increased uses.

The following examples further illustrate this invention.

COMPARATIVE EXAMPLE 1

Two spinning solutions were prepared using an acrylonitrile polymer comprising 97% by weight of acrylonitrile (AN), 1% by weight of methyl acrylate (MA) and 2% by weight of methacrylic acid (MAA) and having a specific viscosity of 0.20 (measured as a solution of 0.1 g of the polymer in 100 ml of DMF containing 0.1 mol of sodium thiocyanate at 25° C.) and aqueous sodium thiocyanate solution and dimethylformamide (DMF) as solvents. Stable conditions for the spinning solutions and those for the coagulation for obtaining fibers having a dense inner structure free of voids by wet spinning were researched and the resultant representative spinning conditions and properties and surface roughness of the monofilaments obtained are shown in Table 1.

TABLE 1

| Experiment No. | Solvent | Spinning solution: Concentration % | Spinning solution: Temperature °C. | Coagulation bath: Composition | Coagulation bath: Temperature °C. | Properties of precursor: Surface roughness | Properties of precursor: Denier d | Properties of precursor: Strength g/d | Properties of precursor: Elongation % | Precursor No. |
|---|---|---|---|---|---|---|---|---|---|---|
| 1 | 50% aqueous sodium thiocyanate solution | 16.0 | 50 | 12% aqueous sodium thiocyanate solution | 0 | 1.7 | 1.30 | 6.0 | 11.5 | A |
| 2 | DMF | 24.5 | 70 | 78% aqueous DMF solution | −5 | 1.5 | 1.31 | 6.3 | 11.8 | B |

The spinning was effected by dry-wet spinning method with a spinning nozzle having 1,500 holes of 0.15 mm diameter each and positioned at a distance of 5 mm above the surface of the coagulation bath. The coagulated filaments were taken-up at a rate of 20 m/min and washed and simultaneously stretched to 7 times their length in boiling water, applied with an oiling agent, thereafter allowed to pass on a hot roller having a surface temperature of 120° C. to collapse and densify the inner portion. Thus obtained precursors had a monofilament of denier of 1.3.

Figure 2:
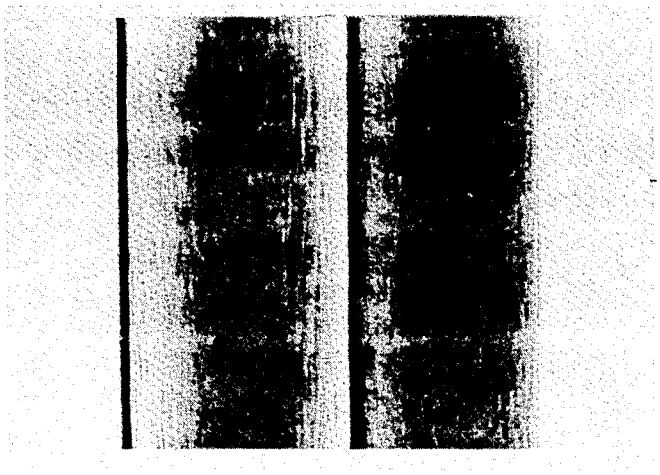

FIG. 2 is an electron photomicrograph of the surface of precursor (A) and FIG. 1 is a line scanning profile of precursor (A) measured by the method for measuring surface roughness as defined hereinbefore.

Precursors (A) and (B) thus obtained were calcined to carbonize them to obtain carbon fibers under the following normal conditions. That is, they were first heat treated by a three-stage furnace of 220° C., 240° C. and 255° C. in air for 60 minutes under a total extension of 5% to flameproof them so as to reach a density of 1.36 g/cc. Then, they were carbonized at an elevated temperature of 500° C. to 1250° C. in nitrogen for 2 minutes under a constant length.

Properties of the flameproofed fibers and the carbon fibers are shown in Table 2. The monofilaments were liable to agglutination or fusion bond with each other and high performance was not attained. This fusion bonding of the filaments was conspicuous at the flameproofing step.

TABLE 2

| Precursor | Properties of flameproofed fibers: Density*1 (g/cc) | Properties of flameproofed fibers: Appearance | Properties of carbon fibers: Tensile strength*3: Density*2 (g/cc) | Tensile strength*3: Strength (kg/mm$^2$) | Tensile strength*3: Degree of variability (CV %) | Tensile modulus*3: Modulus (ton/mm$^2$) | Tensile modulus*3: Degree of variability (CV %) |
|---|---|---|---|---|---|---|---|
| (A) | 1.362 | Considerable bonding | 1.820 | 385 | 6.4 | 25.4 | 1.7 |
| (B) | 1.361 | Much bonding | 1.817 | 372 | 7.1 | 25.5 | 1.6 |

*1Density of the flameproofed fibers was measured at 30° C. by toluene-carbontetrachloride gradient tube density determination method.
*2Density of the carbon fibers was measured at 30° C. by ethylene bromide-carbontetrachloride gradient tube density determination method.
*3Properties of the carbon fibers were measured on 10 filaments by strand method (200 mm in length) according to JIS R7601.

EXAMPLE 1

Investigation was made in increasing surface roughness of fibers of Experiment No. 2 (solvent DMF) in Table 1 of Comparative Example 1 with maintaining the dense inner structure. Thus, an experiment was made for obtaining precursors having a surface roughness of 2 or more by employing coagulation temperature of 5° C. to 25° C. with a concentration of the spinning solution of 26 to 27.5%. A typical example is shown in Table 3.

TABLE 3

| Experiment No. | Spinning conditions: Concentration of spinning solution (%) | Spinning conditions: Coagulation temperature (°C.) | Properties of precursor: Surface roughness | Properties of precursor: Denier (d) | Properties of precursor: Strength (g/d) | Properties of precursor: Elongation (%) | Observation by optical microscope | Precursor No. |
|---|---|---|---|---|---|---|---|---|
| 3 | 26.5 | 15 | 2.6 | 1.32 | 6.1 | 12.2 | Completely round cross section and no voids | (C) |

Figure 3:
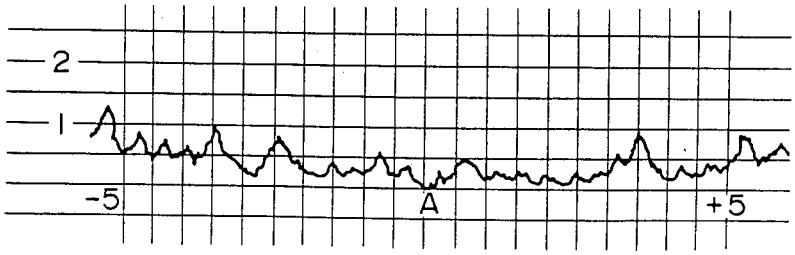
Figure 4:
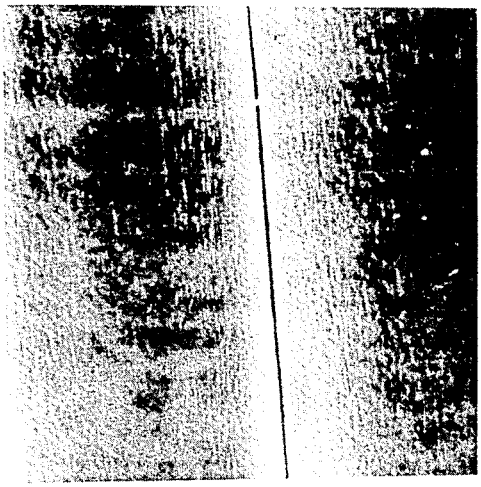

FIG. 4 is a photomicrograph (×3000) of the surface of this precursor (C) and FIG. 3 is a line scanning profile of surface roughness of this precursor which was used for measurement of surface roughness of the precursor.

The precursor (C) was calcined in the same manner as in Comparative Example 1 and the results are shown in Table 4. The resultant carbon fiber tows were soft and had no fusion bonding of monofilaments and had high performance.

TABLE 4

| Precursor No. | Properties of flameproofed fibers: Density (g/cc) | Properties of flameproofed fibers: Appearance | Properties of carbon fibers: Density (g/cc) | Tensile strength: Strength (kg/mm²) | Tensile strength: Degree of variability (CV %) | Tensile modulus: Modulus (ton/mm²) | Tensile modulus: Degree of variability (CV %) |
|---|---|---|---|---|---|---|---|
| (C) | 1.360 | Soft no bonding | 1.819 | 485 | 3.4 | 25.6 | 0.9 |

What is claimed is:

1. A method for producing an acrylic fiber precursor for carbon fibers substantially free of defects from fusion bonding or agglutination, said acrylic fiber comprising an acrylonitrile and methyl acrylate or methacrylic acid copolymer containing at least 90% by weight of acrylonitrile and having a surface roughness of 2.0 to 3.0, the surface roughness being measured in the following manner:

the secondary electron line scanning profile of the acrylic fiber precursor is prepared by a scanning electron microscope at a magnification of 6,600 times, which is magnified to 10,000 times to obtain a line scanning profile in which each distance of 5 cm, corresponding to 5μ in actual measurement, the left and right from the zero level of the line scanning taken as the center are divided into ten equal lengths and heights of respective divided profiles in the direction of the y-axis, and read, and a variance of the heights is calculated according to formula (1) and an arithmetic mean value of the variances obtained on fifty specimens is taken as the surface roughness $$\text{Variance} = \sqrt{\frac{1}{20}\sum_{i=1}^{20}(yi - \bar{y})^2} \quad (1)$$

wherein yi is the height of the profile at a particular division in the direction of the y-axis and $\bar{y}$ is a mean value of the height in the direction of the y-axis; said method comprising:

(i) dry-jet wet spinning a spinning solution comprising 24 to 27.5% by weight of an acrylonitrile polymer containing at least 90% by weight of acrylonitrile and not more than 10% by weight of methyl acrylate or methacrylic acid, and an organic solvent of dimethylformamide or dimethylacetamide into a coagulation bath consisting essentially of the said organic solvent and water at 5° C. to 25° C., and (ii) subjecting the thus spun filaments to simultaneous washing and stretching to 1.05 to 20 times their lengths in hot water or boiling water at a temperature of 50° C. to 100° C., applying oiling agent and subsequently dry-heat stretching.

2. A method for producing an acrylic fiber precursor for carbon fibers substantially free of defects from fusion bonding or agglutination, said acrylic fiber comprising an acrylonitrile polymer containing at least 90% by weight of acrylonitrile and having a surface roughness of 2.0 to 3.0, the surface roughness being measured in the following manner:

a secondary electron line scanning profile of the acrylic fiber precursor is prepared by a scanning electron microscope at a magnification of 6,600 times, which is magnified to 10,000 times to obtain a line scanning profile in which each distance of 5 cm, corresponding to 5μ in actual measurement, the left and right from the zero level of the line scanning taken as the center are divided into ten equal length and heights of respective divided profiles in the directions of the y-axis, and read, and a variance of the heights is calculated according to formula (1) and an arithmetic mean value of the variances obtained on fifty specimens is taken as the surface roughness, $$\text{Variance} = \sqrt{\frac{1}{20}\sum_{i=1}^{20}(yi - \bar{y})^2} \quad (1)$$

wherein yi is the height of the profile at a particular division in the direction of the y-axis and $\bar{y}$ is a mean value of the heights in the direction of the y-axis; said method comprising:

(i) dry-jet wet spinning a spinning solution comprising 24 to 27.5% by weight of an acrylonitrile polymer containing at least 90% by weight of acrylonitrile and an organic solvent of dimethylformamide or dimethylacetamide into a coagulation bath consisting essentially of the said organic solvent and water at 5° C. to 25° C., and (ii) subjecting the thus spun filaments to simultaneous washing and stretching to 1.05 to 20 times their length in hot water or boiling water of 50° C. to 100° C., applying oiling agents and subsequently dry-heat stretching.

3. The method of claim 2, comprising carrying out the spinning by the dry-jet spinning method in which a space of 2 to 50 mm is kept maintained between a nozzle surface and the surface of the coagulation bath.

4. A method for making carbon fibers, comprising carbonizing the acrylic fiber precursor obtained by the method of claim 2.

5. A method for making the carbon fiber of claim 4, comprising first flame-proofing and then carbonizing the said precursor.

6. The method of claim 4, comprising carrying out the said carbonization by heat treating the precursor at a temperature of 500° C. to 1800° C. in a non-oxidizing atmosphere.

7. The method of claim 5, comprising carrying out the flameproofing by (i) heat treating the said precursor in an oxidizing atmosphere at 200° C. to 400° C., or (ii) oxidizing the said precursor with a liquid oxidizing agent.

8. The method of claim 7, wherein the said precursor oxidized with a liquid oxidizing agent is further heat treated at a temperature of 200° C. to 400° C. in an oxidizing atmosphere.

9. The method of claim 4, wherein the said carbonized precursor is further heat treated at a temperature of 3000° C. or less to obtain graphitized fibers.

* * * * *